US005110052A

United States Patent [19]

Graf et al.

[11] Patent Number: 5,110,052

[45] Date of Patent: May 5, 1992

[54] MANUALLY OPERABLE DISCHARGING APPARATUS FOR MEDIA

[75] Inventors: Lothar Graf, Rielasingen-Worblingen; Karl-Heinz Fuchs, Radolfzell; Leo Maerte, Sipplingen, all of Fed. Rep. of Germany

[73] Assignee: Ing. Erich Pfeiffer GmbH & Co. KG, Fed. Rep. of Germany

[21] Appl. No.: 455,361

[22] PCT Filed: Jul. 5, 1988

[86] PCT No.: PCT/EP88/00597

§ 371 Date: Feb. 7, 1990

§ 102(e) Date: Feb. 7, 1990

[87] PCT Pub. No.: WO89/00085

PCT Pub. Date: Jan. 12, 1989

[30] Foreign Application Priority Data

Jul. 8, 1987 [DE] Fed. Rep. of Germany ..... 3722469

[51] Int. Cl.[5] ..... B05B 9/043

[52] U.S. Cl. ..... 239/333; 239/337

[58] Field of Search ..... 239/333, 337, 402, 404, 239/406, 466; 222/631, 635, 321

[56] References Cited

U.S. PATENT DOCUMENTS 4,057,176 11/1977 Horvath ..... 239/333
4,179,049 12/1979 Umstead ..... 222/631
4,214,677 7/1980 Bauer et al. ..... 239/333
4,516,727 5/1985 Saito et al. ..... 239/333

FOREIGN PATENT DOCUMENTS 2317969 2/1977 France .
2397341 2/1979 France .
2407752 6/1979 France .

*Primary Examiner*—Andres Kashnikow
*Assistant Examiner*—Lesley D. Morris
*Attorney, Agent, or Firm*—Eckert Seamans Cherin & Mellott

[57] ABSTRACT

In a manually operable discharging apparatus (1) in the extension of the medium pump (2) provided for conveying the medium and in directly equiaxial manner at the outer end thereof is provided a compressed air pump (50) located in a cap-like, common handle (22), with which by means of a compressed air duct (90) separate from the medium supply for furthering atomization compressed air can be delivered to the discharge nozzle (25) or in other areas of the discharging apparatus (1), e.g. to the medium discharge duct (24), so that it is also possible to clean said duct by blowing free. The compressed air pump (50) can be constructed in such a way that it starts with the compressed air delivery prior to the medium delivery of the medium pump (2) and ends after this. In addition, appropriately there is an at least two-stage atomizing device (100) for the additional atomization of a preatomized medium flow with a nozzle air flow in the vicinity of discharge nozzle (25).

23 Claims, 7 Drawing Sheets

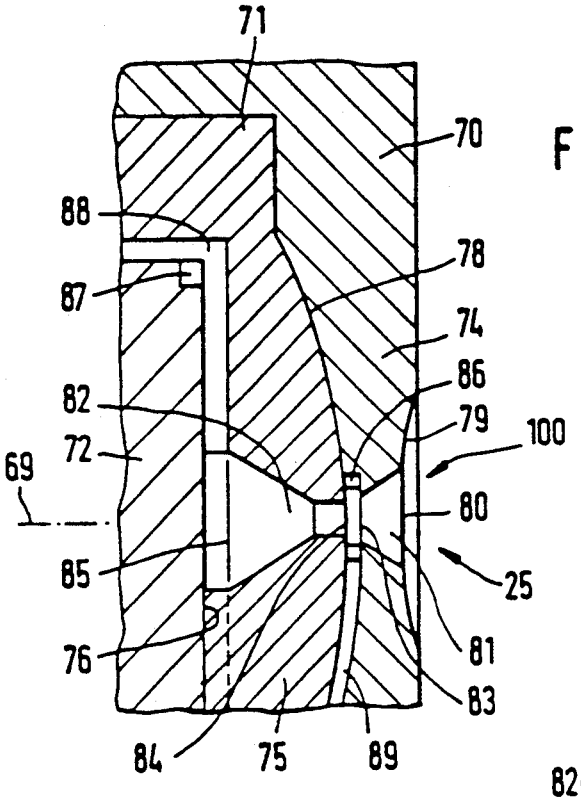
FIG.4
FIG.5
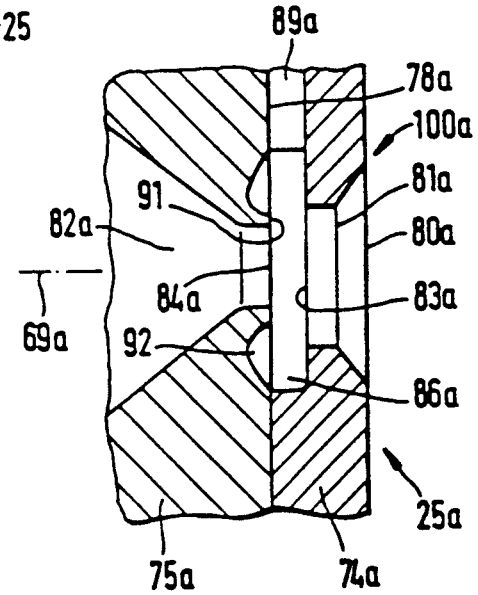
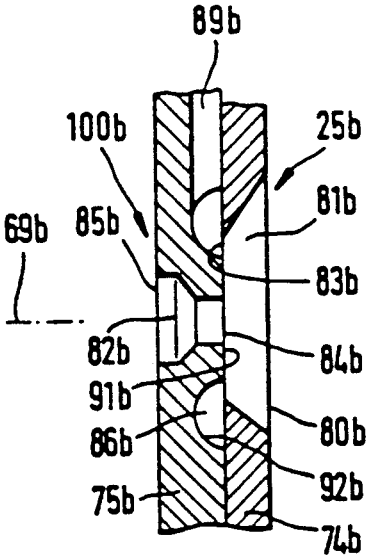
FIG.6

FIG.7
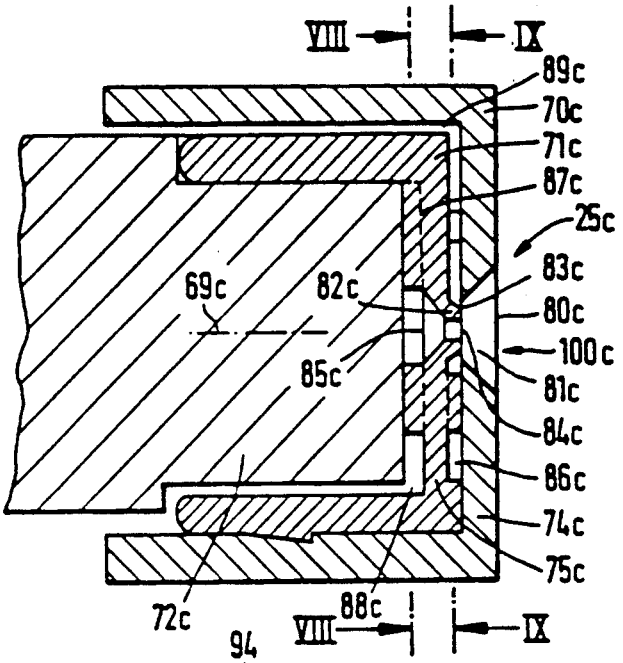
FIG.9
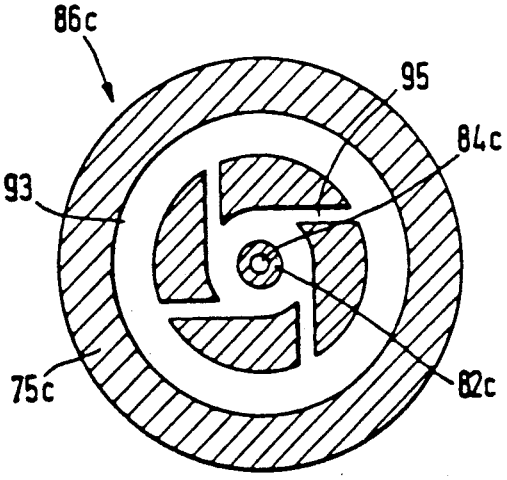
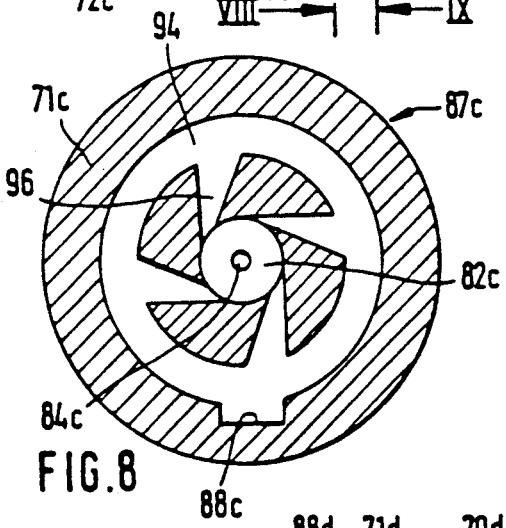
FIG.8
FIG.10
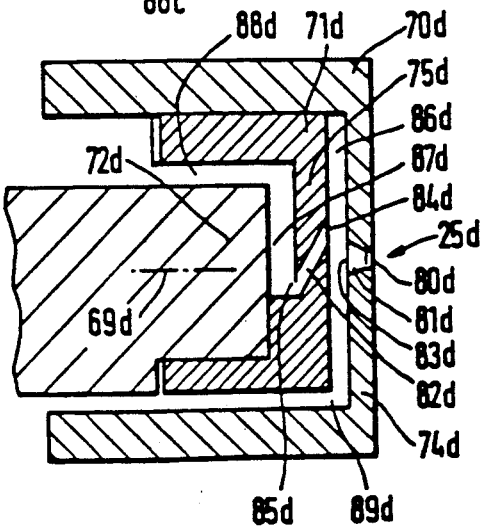

MANUALLY OPERABLE DISCHARGING APPARATUS FOR MEDIA

BACKGROUND OF THE INVENTION

The invention relates to a manually operable discharging apparatus for media.

Numerous discharging apparatuses are known, in which in addition to a media pump, a further pump is e.g. provided for carrying out the pumping work when the discharging apparatus is in the overhead position or for pumping a second medium out of a separate vessel.

SUMMARY OF THE INVENTION

An object of the present invention is to provide a manually operable discharging apparatus which, in addition to the pressure source for conveying the media, has a pressure source for making available a pressurized gas flow in such a way that as a result in simple manner the discharging behavior in the vicinity of the discharge nozzle can be influenced.

According to the invention, this object is acheived in that a discharging apparatus of the aforementioned type is characterized by a manually pressure source, such as a compressed air pump, with which is associated a compressed air chamber, which is connected by means of a compressed air duct to the discharge nozzle.

The compressed air pump can be connected directly via a line or pipe connection to the discharge nozzle or e.g. to a pressure tank formed by the reception vessel for the medium or a separate pressure tank, which supplies the discharge nozzle, the pressure in the pressure tank simultaneously being usable for conveying the medium from the vessel towards the discharge nozzle.

It is particularly advantageous if the pressurized gas source is used for ultra-fine atomization, for cleaning connecting lines for the medium, for valve control and/or for similar purposes, so that even in the case of manually operable discharging apparatuses of a size which can essentially fit into a closed hand, or which can be readily held and operated with one hand, same can be produced with numerous functions, which are otherwise only possible in the case of discharging apparatuses connected by means of pipes to pressure sources or pumps. Thus, the discharging apparatus can be completely closed, autarchic apparatus, or which is independent from external pressure sources and which in overhung manner only has one storage vessel for the medium, a cap or the like closing the same and carrying the pressure sources, as well as an operating unit e.g. in the form of a single operating head, which leads to extremely handy dimensions and a simple construction with high operating reliability.

BRIEF DESCRIPTION OF THE DRAWINGS

These and further features of preferred further development of the invention can be gathered from the claims, description and drawings, whereby the individual features can be realized either alone or in the form of combinations in an embodiment of the invention and in other fields and can in themselves represent advantageous constructions, for which protection is here claimed. Embodiments of the invention are described hereinafter relative to the drawings, in which:

FIG. 4 shows a detail in the vicinity of the discharge nozzle of FIG. 3 on a still larger scale.

FIG. 5 shows another embodiment in a representation corresponding to FIG. 4.

FIG. 6 shows another embodiment in a representation corresponding to FIG. 4.

FIG. 7 shows a further discharge nozzle in axial section.

FIG. 8 shows a section roughly along line VIII—VIII on FIG. 7, but without an external nozzle cap.

FIG. 9 shows a corresponding section along line IX—IX in FIG. 7.

FIG. 10 shows another embodiment of a discharge nozzle in axial section.

DETAILED DESCRIPTION OF THE PREFERRED EMBODIMENTS

Figure 3:
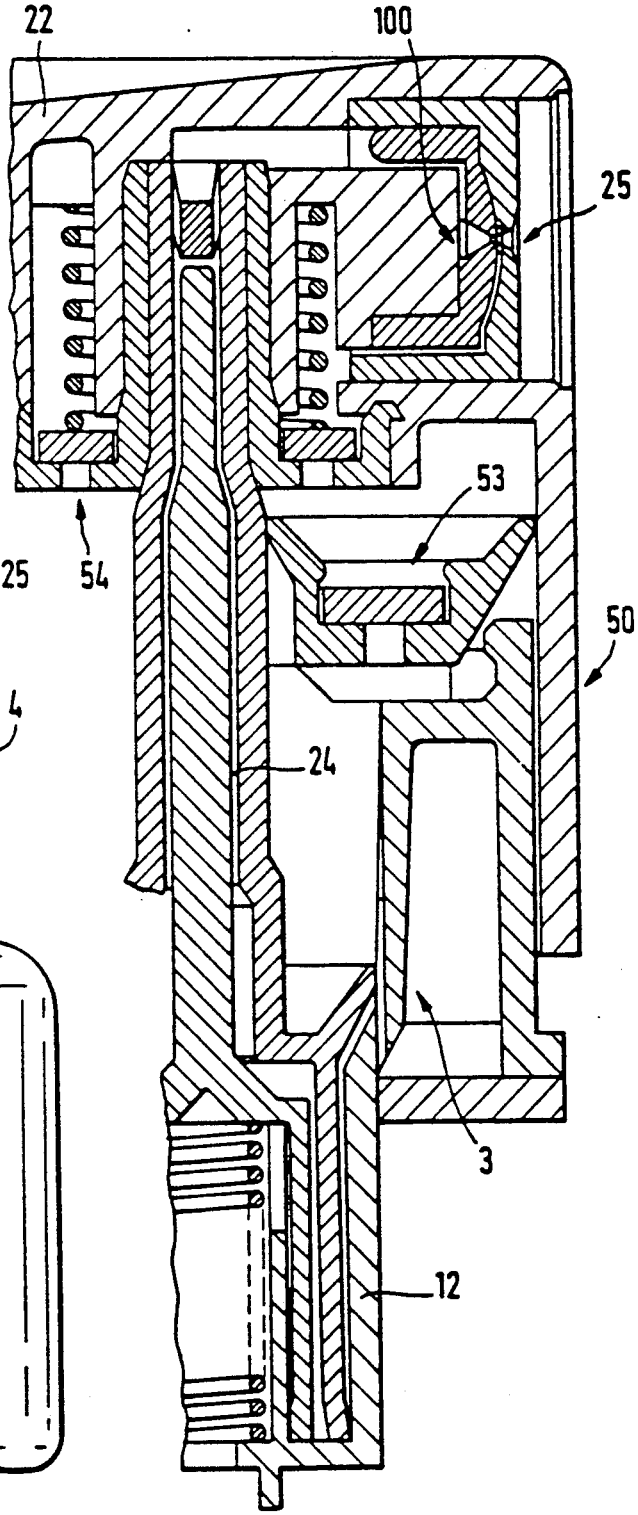
FIG. 3 shows a detail of FIG. 2 on a larger scale, but in a different piston unit position.

The discharging apparatus 1 shown in FIGS. 1 to 4 has a thrust piston pump 2 with a cylinder casing 3 to be fixed by a basic support body, such as cap 4, to the neck of a vessel 5 constituting a reservoir. The cylinder casing 3 is axialy braced against the end face of the vessel neck with an annular flange 6 and a whilst interposing a gasket 42 and axially outside the annular flange 6 is provided with a cylinder head or cover 7 to be described hereinafter. In the vicinity of said outer end, the cylinder casing 3 passes via a radially downwardly projecting partition 8 into a sleeve surrounding the same and which is provided at the opposite end with the annular flange 6.

A piston unit 9 having two coaxially telescoping working pistons, namely an outer pump piston 10 and a presuction piston 11 located in the same is displaceably mounted in cylinder casing 3. The inner end of cylinder casing 3 projecting into vessel 5 forms a cylinder with a piston running path 13 for two sealing lips on the ends of the pump piston 10. Within the cylinder 12 is provided a presuction cylinder 15 projecting freely against the piston unit 9 from an annular bottom wall 18 and into which issues an inlet passage 19, which projects inwards from bottom wall 18 in the opposite direction. The outer circumference of presuction cylinder 15 forms the piston running path 16 for the presuction piston 11 engaging over it.

The space between the piston running path 13, 16 is formed by the pump chamber 14, in which is coaxially located the presuction chamber 17 bounded by presuction cylinder 15 and presuction piston 11 and in which is arranged a restoring spring 20 loading the piston unit 9 towards the starting position.

The outer or rear end of pump piston 10 is provided with a tubular piston shaft located in the axis thereof and guided outwards through the cylinder cover 7 and which bounds an outlet passage 24 connected to pump chamber 14, whilst interposing an outlet valve 23. Outlet passage 24 leads to a discharge nozzle 25 in a handle 22 in the form of operating head arranged at the outer end of piston shaft 21 and which in each position engages with a small gap over the sleeve of cylinder casing 3.

An end wall of the presuction piston 11 facing the presuction chamber 14 forms a frustum-shaped valve closing part 26 of the outlet valve 23, whose valve seat 27 is provided on a associated end wall of pump piston 10. A shaft 28 for opening outlet valve 23 projects from the presuction piston 11 displaceably into the piston shaft 21. A portion of the piston shaft 21 connected to pump piston 10 forms an elastically resilient, compressible neck 29.

On operating the discharging apparatus by pressing down handle 22, on reaching a predetermined pressure, outlet valve 23 is opened by differential pressure. For filling the pump chamber 14 during the return stroke of the piston unit 9 is provided a pass-over valve 32 which, in displacement-dependent manner, is only open over a final portion of the return travel of the piston unit extending to the starting position, but is closed over most of the pump stroke extending to the pump stroke end position. The closing part 33 of this slide valve is formed by the front piston lip of the presuction piston 11 with which are associated approximately axial valve slots 39 at the free end of presuction cylinder 15 to constitute valve openings. As soon as the presuction piston 11 has reached in the direction of the pump stroke the terminal edges of the valve slots 39 provided as valve closing edges 34, the pass-over valve 32 is closed and correspondingly it is reopened in surge-like manner during the return stroke for the presuction piston 11 and after a vacuum has built up in pump chamber 14. At the end of the pump stroke, the two end faces 30, 31 of the pump piston 10 and the presuction piston 11 can strike in time-delayed manner against bottom wall 18 in such a way that the outlet valve 23 is opened, optionally for ventilating the pump chamber 14. The cup-shaped presuction piston 11 has a piston sleeve 35 forming the end face 30 and which approximately extends over the entire length of a piston sleeve 36 of pump piston 10.

The piston shaft 21 has a driver or dog 40 facing with limited spacing the end of shaft 28 and which on shortening the neck 29 runs up after the pump piston 10 has struck shaft 28 in the pump stroke end position and consequently opens the outlet valve 23. The thrust piston pump 2 also has a displacement-dependent, valve-controlled ventilation means for vessel 5. Between the two piston lips of pump piston 10 are provided in the surface of cylinder casing 3 ventilating through-openings 43, which are immediately adjacent to the outside of the gasket 42 in the vicinity of an annular clearance, which is bounded by gasket 42 and the outer circumference of cylinder casing 3. The passage openings are provided at the end of longitudinal channels 44, which are freed to the outside for producing the ventilation connection at least towards the end of the pump stroke from the rear lip of the pump piston 10. The discharging apparatus 1 can be constructed in accordance with German patent application P 37 15 301.3, particularly with regards to the described parts or assemblies and reference should be made thereto for further details and actions. However, the pump can also be formed by a completely different, manually operable pump type, e.g. a bellows, diaphragm, balloon or similar pump. It is also conceivable to construct the medium pump in such a way that it initially produces a precompressed pressure in vessel 5 and a result the medium is conveyed via a riser to the outlet passage and to the discharge nozzle 25, as is e.g. described in German patent application P 37 12 327.0.

Apart from the medium pump 2, a preferably manually operable compressed air pump 50 is associated as a compressed air source with the discharging apparatus 1 and is constructionally separate from pump 2 or vessel 5 and can optionally also be constructed as a foot-operable pump and is then appropriately connected by means of a line, such as a flexible hose to the vessel or the part of the discharging apparatus 1 arranged thereon. This compressed air pump can also be formed by different pump types, e.g. those explained with respect to the medium pump. However, in the case of a particularly advantageous embodiment the compressed air pump 50 is constructed as a thrust piston pump, is constructionally combined with the discharging apparatus 1, is operated substantially simultaneously with the same handle 22 as the medium pump 2 and is arranged equiaxially within and/or axially immediately adjacent to the medium pump 2 and appropriately following on to the outer end thereof. Although it is conceivable to connect the compressed air pump 50 to the discharge passage 24 or the discharge nozzle 25, accompanied by the interposing of a pressure tank to be loaded threwith by means of a manually operable valve, a particularly simple construction is obtained if the compressed air pump 50 directly connected, so that compressed air is essentially only conveyed during operation.

The compressed air pump 50 has a pump piston 51, a pump cylinder 52 receiving the same, an air inlet valve 53 integrated with the pump piston 51 and an air outlet valve 54 constructionally combined with the pump cylinder 52, which are equiaxial to one another and located in the central axis of the medium pump 2 substantially entirely within the outer boundaries of the cap-like handle 22. Although it is conceivable, much as for the medium pump 2, to move the pump piston by operation with respect to the casing arranged on or fixed to vessel 5, according to a preferred embodiment the pump piston 51 is fixed with respect to said casing or on cylinder casing 3 and pump cylinder 52 is movable with handle 22.

In a very similar construction, without a separate cylinder casing being necessary for the compressed air pump 50, the pump cylinder 52 is directly formed by the cap surface of handle 22 engaging over the sleeve 46 of cylinder casing 3 and whose inner circumference over part of its length forms the piston running path 55 for a radially outer lip 56 of pump piston 51 conically widened in acute-angled manner towards the cap end wall of handle 2. A corresponding, radially inner piston lip 57 of pump piston 51 conically tapered in the same direction runs on the cylindrical outer circumference of a portion of the piston shaft 21 connected to neck 29 and extending approximately to the connection with handle 2.

For fixing purposes, the pump piston 51 has at its end face remote from the piston lips 56, 57 an aproximately annular snap element 58, which is inserted in an annular clearance on a collar-like shoulder constructed as an inner groove and which as an extension of sleeve 46 projects slightly from the side of partition 8 remote therefrom, so that pump piston 51 is supported axially against the pump pressure by engaging on partition 8. On said end side of the pump piston 51 is also provided the cylinder cover 7 in the form of ribs projecting radially into the vicinity of the associated widened section of the cylinder bore of cylinder casing 3 and uniformly distributed about the pump axis, which can be constructed in one piece with cylinder casing 3 or the pump piston 51 made from a relatively soft material, so that in the starting position of pump piston 10, the medium pump 2 with its rear piston lip can strike relatively softly against cylinder cover 7.

It is also conceivable for the cap circumferential surface or pump cylinder 52 to run in sealed manner with respect to sleeve 46 with a sealing lip or the like, so that the casing or the associated part of the cylinder casing 3 can directly form in one piece the pump piston. However, appropriately the gap between the pump cylinder 52 and the casing forms an inlet slot for the ventilation air for vessel 5 and/or for the suction air for compressed air pump 50, which appropriately on and beyond the outer circumference of pump piston 51 between interruptions or breaks in the snap element 58, drows the suction air through the pump piston 51 from its back surface remote from the piston lips 56, 57.

For this purpose in a ring disk-like bottom wall connecting the piston lips 56, 57 is provided ring-distributed air passage openings, which can be closed with a ring disk-like valve body 60 made from an elastic material in the manner of a non-pretensioned check valve. Valve body 60 is located on the inside of the bottom wall between piston lips 56, 57 and is stop-limited in the opening direction by at least one and in particular two coaxial tori 61, which are provided on the facing circumferential sides of the piston lips 56, 57 in spaced manner from the bottom wall, said spacing being only slightly larger than the thickness of valve body 60.

The smaller diameter, but similarly constructed outlet valve 54 operates in the manner of a pretensioned overpressure valve, which only opens on reaching a predetermined overpressure in the pump or pressure chamber 62 and releases the path for the compressed air to the discharge nozzle 25. In a bush 63 projecting inwards from the cap end wall of handle 22 over most of the circumference with a radial spacing from the cap circumferential surface is inserted a collar sleeve-like insert 64 with a flange-like collar and is so secured by a snap connection that the collar terminates approximately flush with the free end face of bush 63. In the ring disk-like part of the collar of insert 64 passage openings are arranged in a ring and can be closed by a ring disk-like valve body 65. Valve body 65 engages on the end face of the collar of insert 63 remote from the pressure chamber 62 under the tension of a valve spring 66 constructed as a helical compression spring and which is arranged in an annular clearance between a bush 63 and a further plug bush 67 of handle 22 positioned coaxially within the same. In said plug bush 67 is inserted the sleeve portion of insert 64, in which in turn is inserted the associated, smaller outer diameter end of the piston shaft 21 in the manner of a press fit, in such a way that there is a substantially rigid connection between piston shaft 21 and handle 22, the free end faces of piston shaft 21 and the sleeve portion of insert 64 are located flush with one another adjacent to the cap end face of handle 22 and the dog 40 is provided in the associated end region of piston shaft 21.

The discharge nozzle 25 is formed substantially by four bodies approximately coaxial and at right angles to the central axis of the medium pump 2 or the compressed air pump 50, namely nested nozzle caps 70,71, an inner body 72 engaging in the inner nozzle cap 71 and an outer bush 73 receiving on the outer circumference the outer nozzle cap 70 and which can be constructed in one piece with inner body 72 or can be constructed like the latter with the handle and is appropriately connected both to the circumferential surface of bush 63 and to the cap end wall of handle 22. The end walls of the nozzle caps 70,71 essentially at right angles to nozzle axis 69 form nozzle end plates 74,75, which engage on one another in approximately whole-surface manner, the end face 76 of inner body 72 engaging in approximately whole-surface manner on the inner end face of the rear nozzle end plate 75 and the front nozzle end plate 74 is set back with respect to the front end face 77 of outer bush 73 by less than half of its internal diameter corresponding to the external diameter of the nozzle cap 70. The nozzle end plate 75 is thickened towards the nozzle axis by convex projecting construction of its outer end face 78 and engages with the latter in a substantially whole-surface manner on a corresponding concave portion of the inner end face of the nozzle end plate 74.

The nozzle end opening 80 leading into the open is approximately located in the outer end face of the nozzle end plate 74 or is slightly set back with respect thereto in the bottom surface of a flat depression 79, so that the nozzle end opening 80 is set back with respect to the front end of outer bush 73 and is shielded to the front by the latter. The nozzle passage of the discharge nozzle 25 is essentially formed by two separate individual passages or nozzles 81,82, which are positioned equiaxially directly behind one another.

The front nozzle 81 formed by a corresponding nozzle passage in the nozzle end plate 74 and whose nozzle exit opening is formed by the nozzle end opening 80 has a smaller length than its median or minimum width and is continuously conically widened in acute-angled manner over its entire length from a nozzle inlet opening 83 in the vicinity of the inner end face of nozzle end plate 74 to the nozzle outlet opening.

The rear nozzle 82 formed by a nozzle passage in the nozzle end plate 75 compared therewith and compared with its median diameter has a greater length, which is smaller compared with its greatest diameter and is constricted in the flow direction or in the direction of the upstream nozzle 81. A rear longer portion is conically tapered in acute-angled manner from an associated nozzle inlet opening 85 located in the inner end face of the nozzle end plate 75 and to its smallest diameter is connected a constant width or diameter portion extending up to associated nozzle outlet opening 84 located in end face 78, so that there is both a continuous and a stepped constriction of said nozzle 82 to a minimum width, which is slightly smaller than the smallest width of nozzle 81.

Between the two individual nozzles 81,82 is provided a whirling device 86 constructed in one piece with at least one of the two nozzle end plates and in particular the front plate 74 and which is formed by a further whirling chamber facing inlet opening 83 and outlet opening 84 and whose axial extension is significantly smaller than the at least one and in particular the shorter nozzle 81. With the nozzle inlet opening 85 of the rear nozzle 82 is also associated a whirling device 87, which is also formed by a flatter whirling chamber substantially located in the nozzle axis, which faces the inlet opening 85 and is much flatter than the length of said individual nozzle and which can be constructed in one piece with the inner body 72 and/or the nozzle end plate 75. For simplifying the construction the whirling devices 86,87, as well as the associated feed lines can be constructed with a single nozzle body in one piece in such a way that only this is provided on the inner and outer end face of the associated nozzle end plate 75 with the corresponding shapes diverging from the smooth shaping, namely with corresponding depressions. Thus, through changing only a single component, the discharge nozzle 25 can be adapted to the characteristics of the fluid to be atomized. It is also conceivable to provide three or more individual nozzles, e.g. for successively feeding compressed air into the medium flow or for supplying the medium or two or more different media in separate streams to the discharge nozzle 25.

The rear individual nozzle 82 or its whirling device 87 is connected by means of a channel portion 88 provided as an end portion to the medium outlet channel 24, whilst the front individual nozzle 81 or its whirling device 86 can be connected by means of a channel portion 89 constructed as an end portion to a compressed air channel 90 connected to outlet valve 54. The cross-sectionally angular medium channel portion 88 is formed by corresponding grooves on the inner circumferential surface and on the inner end face of the inner nozzle cap 71 and is bounded by these and by the inner body 72 and is also connected by means of an intermediate channel to the outer end of piston shaft 21 or outlet channel 24, the intermediate channel is tightly closed with respect to the compressed air guide between inner body 72 and the cap end wall of handle 22. The compressed air channel portion 89 is also angular and about the nozzle axis with respect to the channel portion 88 is appropriately diametrally displaced between the cap circumferential surfaces and the nozzle end plates 74,75 of nozzle caps 70,71 and is formed by corresponding axial and radial grooves, which can be located on the outer face of nozzle cap 71, but in the represented embodiment are located on the inside of nozzle cap 70. In the compressed air channel 90 is located the annular clearance receiving the valve spring 66 and up to which approximately extends the compressed air channel portion 89 with its axial portion.

The radial end portions of channel portions 88,89 are substantially radially or tangentially connected to the in each case associated whirling chamber, so that the conveyed medium flows in rotating or whirling manner about the nozzle axis in the vicinity of the associated nozzle inlet openings 85,83 and thus enters the associated nozzle channel.

The described construction forms an at least two-stage or multistage atomizer 100, with which the medium flow is preatomized in the vicinity of the whirling device 87 and individual nozzle 82 to material droplets with a size of e.g. 50 to 70 μm and is then more finely atomized at least once by compressed air acceleration and as a result of the subsequent air atomization the material droplet or particle size is reduced by approximately a power of ten. This is particularly the case if the dimensions for obtaining a Laval effect are such that the compressed air flow accelerates the material droplets or particles approximately to or even above the speed of sound and they are further broken up on meeting the atmosphere directly on leaving nozzle opening 80 and accompanied by impact force. For forming the nozzle geometry of the front individual nozzles 81 according to the Laval effect, it is appropriate if in the vicinity of its nozzle inlet opening it has a relatively small width and then becomes very wide via a gentle, trumpet-shaped transition or conical surfaces. The smallest width of individual nozzle 81 is appropriately below 2 or 1.5 mm and is preferably below 1 mm and is over 0.1 mm, preference being given to 0.5 mm. Thus, the individual nozzle 82 constructed as a hollow cone nozzle has a minimum width of smaller size and which is approximately half the smallest width of nozzle 81 or even less than this and can be less than 0.1 mm and is preferably between 0.1 and 0.2 mm. In the case of an air supply with a pressure of 2 bar and 10 m/s, in the described construction approximately the speed of sound is reached at the outlet from nozzle 81 and it is theoretically possible to obtain a droplet size of the atomized liquid of up to 0.632 μm, but in practice due to the compressibility of air a value of up to approximately 5 μm can be achieved.

Instead of providing a whirling device 86 for the compressed air, it is also conceivable for the arrangement or a chamber provided in place of whirling device 86 to be such that the compressed air enters in axially parallel manner to the nozzle axis and in bundled or focused form into the nozzle 81 and as a result internal frictional losses are further reduced. The axial extension of said chamber or the whirling chamber is appropriately of the same order of magnitude as the smallest width of the individual nozzle 82 or is approximately e.g. a fifth of the smallest width of nozzle 81 and is preferably below 1 mm or 0.5 mm and preferably approximately 0.1 mm.

For finer or additional atomization, it is also possible to provide in facing upstream manner with respect to the nozzle end opening 80 an impact member, against which is hurled the liquid and is consequently atomized and deflected at right angles to the nozzle axis and then the compressed air flow accelerated to sonic or supersonic speed is supplied e.g. by using the Laval effect. The nozzle exit opening for the compressed air can in this case be e.g. provided around the nozzle exit opening for the liquid or around the plate-like impact member, so that the compressed air takes over the preatomized liquid at the edge of the impact member and deflects it again parallel to the nozzle axial direction, so that the liquid droplets accelerated in this way by the compressed air are centrifuged against the atmosphere and are further disintegrated by bursting under the pressure which occurs.

However, in the represented embodiment the compressed air is admixed upstream of the individual nozzle 81, so that a medium compressed air mixture flows out through the end or single nozzle 81. Instead of the medium nozzle being constructed as a hollow cone nozzle, it can e.g. be constructed as a full or solid cone nozzle, as a rectangular cone nozzle, as a flat jet nozzle, or e.g. as an axial whirling nozzle or a two or multi-substance nozzle, as a function of the requirements to be made on the medium to be processed. A construction as a double hollow cone nozzle is also conceivable. It can in particular be advantageous if the discharge nozzle is constructed as an ultrasonic nozzle with a longitudinal and/or circular capillary waves.

The described discharging apparatus operates according to the following process. By pressing down handle 22 with the finger of a hand otherwise holding vessel 5, both the medium pump 2 and the compressed air pump 50 start the pump stroke counter to the action of the single, joint restoring spring 20. The latter, as the valve spring, also keeps outlet valve 23 closed. After a first stroke section, e.g. corresponding to a quarter of the total stroke, the suction or pass-over valve 32 is closed and a fluid overpressure is produced in pump chamber 14, provided that filling has taken place with the medium to be discharged.

Simultaneously an overpressure is produced in the pressure chamber 62 of the upper pump provided as a pressurized gas source, the pressurized gas being compressed. The two pressure systems are in this state still completely closed or sealed with respect to one another. During the further stroke movement and as a function of the setting of the force of the two separate valve springs, on the one hand the outlet valve 23 and on the other hand the pressurized gas outlet valve 54 open. These two valves can be set in such a way that the medium outlet valve 23 opens before the pressurized gas outlet valve 54, or simultaneously therewith or after the same, so that the compressed air reaches and flows through the discharge nozzle 25 either after, with or before the medium.

The two pump flows formed by the medium and the pressurized gas are separately supplied by means of separate pipes to the discharge nozzle 25 and are only combined in the vicinity of the mixing or whirling chamber 86, after the medium has already been preatomized within the intermediate zone. Immediately following the combination of the two pressure flows, the surge-like acceleration thereof takes place in the discharge direction and at the latest immediately following the discharge through the nozzle end opening 80 this leads to a finer atomization of the medium droplets and to a very intense and therefore relatively far-reaching spray jet, which can also be very closely bundled or focussed. Thus, the discharging apparatus is suitable both for medical active substances, such as e.g. inhalation products, and for technical purposes for the spraying of lacquers, e.g. water-soluble paints, oils, for chemical substances and the like, without it being necessary to store propellent gas in vessel 5 for atomization purposes. The pressurized gas source can optionally be an e.g. cartridge-like pressurized gas reservoir with an outlet valve, which is then appropriately opened by operating handle 22.

At the latest on reaching the pump stroke end position the handle 22 is released, so that the medium outlet valve 23 closes under the tension of restoring spring 20. The pressurized gas outlet valve 54 can be adjusted in such a way that it closes before, simultaneously with or after the medium outlet valve 23, so that in the latter case the still flowing compressed air cleans or frees the discharge nozzle 25 from medium residues. After closing check valve 23, the restoring spring 20 carries with it the entire piston unit 9 and the compressed air pump cylinder 52 to the starting position, so that a vacuum builds up in the pump chamber 14 and medium is sucked into the presuction chamber 17 by a riser 47 extending approximately to the vessel bottom and arranged at the inlet passage 19.

Simultaneously under the vacuum in the pressure chamber 62, the compressed air inlet valve 53 is opened, so that in the case of closed outlet valve 54 air is sucked into the pressure chamber 62 between the rear end of piston unit 9 or pump piston 10 and the back of the compressed air pump piston 51, as well as through the latter. As soon as valve 32 has opened through freeing the valve slots 39, the liquid passes from the presuction chamber 17 into pump chamber 14, so that the latter is filled again and the discharging apparatus is ready for the next pump stroke. In this starting position the ventilation connection to vessel 5 is tightly closed by the rear piston lip of pump piston 10, whereas during the pump stroke it is opened at the latest following the opening of pass-over valve 32. The described construction permits a very precise dosing of the medium quantity discharged per pump stroke, the discharging apparatus having a simple and compact construction, so that in substantially position-independent manner it operates equally well in the upright and overhead position and even in the latter with the piston unit in the starting position an outflow of the vessel is prevented by the discharging apparatus.

In FIGS. 5 to 14 the same reference numerals as hereinbefore are used for the corresponding parts, but are followed by different letters. Thus, the previous description also serves hereinafter, to the extent that there are no different features and effects.

In the embodiment according to FIG. 5 the nozzle channel of the end nozzle **81*a* is also cross-sectionally stepped, a constant width spacing following onto the inlet opening 83*a* and which passes into an obtuse-angled, conical portion of roughly the same length, whose wide end forms the nozzle end opening 80*a*. The nozzle outlet opening 84*a* of nozzle 82 is formed by a cross-sectionally, acute-angled ring edge with an inner flank parallel to nozzle axis 69*a*. The compressed air flow or the channel portion 89*a* issues in the vicinity of the flow tear-off edge 91, which is located in the plane of the end face of mixing chamber 86*a* facing the single nozzle 81*a* and is so surrounded by a cross-sectionally, obtuse-angled, V-shaped annular groove that its one lateral flank forms the ring-outer flank of the tear-off edge 91. This ring groove 92 can form part of the whirling device for the compressed air, which consequently rotates about the tear-off edge 91 or its ring-outer flank. The tear-off edge can be formed by a terminal edge or a radially inwardly directed circumferential edge, as well as by the inlet region of the front individual nozzle. Here again the axial extension of nozzle 81*a*, optionally including the axial extension of chamber 86*a*, is much smaller than that of nozzle 82*a*, whilst the diameter of inlet opening 83*a* roughly corresponds to the diameter of the lowest point of the annular groove 92**.

According to FIG. 6 the opening of the pressurized gas channel so surrounds the nozzle axis **69*b* with chamber 86*b* that the two pressure flows only meet in the vicinity of the nozzle channel of nozzle 81*b* and/or in the discharge direction following the same, the compressed air flow being supplied around the preatomized medium flow as an optionally rotary envelope flow directed axially parallel to the nozzle axis 69*b*. The nozzle outlet opening 84*b* is in this case surrounded by an annular end face 91*b* of individual nozzle 82*b* at right angles to nozzle axis 69*b*, whereby said end face at the outer circumference passes into the ring-inner flank of chamber 86*b*, which is formed by an annular groove 92*b* shaped into the associated end face 78*b*. The outer width of the end face 91*b* is smaller than the inner width of the inlet opening 83*b*, which consequently annularly surrounds the outlet opening 84*b*. To this end the end face 91*b*, which can also be frustum-shaped in obtuse-angled manner, is located at least approximately in the plane of the inlet opening 83*b*, whereby also a position of the outlet opening 84*b* between the two ends of the channel of the individual nozzle 81*b* or opposite its outer end or outwardly displaced with respect to opening 80*b*** is conceivable.

To this end, the discharge nozzle 25b approximately has at least two directly adjacent individual nozzles 81b,82b, which are arranged in succession particularly in the direction of the nozzle axis 69b and/or which are approximately concentric. Preferably one of them as the end nozzle 81b forms the nozzle end opening 80b and the other medium nozzle 82b only connected to the medium outlet passage can be set back with respect to the nozzle end opening 80b. If the individual nozzle 82b e.g. projects concentrically into individual nozzle 81b, then the annular nozzle channel bounded by these two nozzles is appropriately conically tapered outwards or e.g. in the discharge direction, so that both the outer circumference of the inner nozzle and the inner circumference of the outer nozzle is tapered, whereby the cone angle of these two circumferential surfaces can differ in such a way that the annular nozzle channel provided for the compressed air flow slightly decreases outwards in passage cross-section. Particularly in this case, but also in other cases, the nozzle channel of the medium nozzle can have a front, funnel-shaped-widened end portion forming the associated outlet opening, so that e.g. said nozzle channel has a constriction between its ends and from which it is conically and/or stepped widened towards both ends.

FIGS. 7 to 9 show two whirling devices 86c, 87c on a discharge nozzle 25c, which is constructed similar to that of FIG. 6. Channel portion 89c or 88c issues into the associated whirling device 86c or 87c in the vicinity of a ring channel surrounding nozzle axis 69c, the opening being provided radially or tangentially corresponding to the associated whirling direction, so that the compressed air flows round in rotary manner in the whirling direction in ring channel 93, 94. From ring channel 93 or 94 or from its inner circumference ducts 95 or 96 branch off inwards and are bounded by guide members constructed in one piece with the associated nozzle body, have a much smaller passage cross-section than the ring channel 93 or 94 and in the associated flow direction can continuously taper or have a constant cross-section. For each whirling device there can be one, two, three, four or more ducts uniformly distributed about the central axis, appropriately the sum of the passage cross-sections of the ducts 95 or 96 being larger than that of the associated ring channel 93 or 94. The ducts 95 or 96 issue into an inner area bounded by the associated guide bodies, which in the case of the whirling device 87c is the annular space surrounding the rear end of the nozzle channel of nozzle 82c and in the case of whirling device 86c that surrounding nozzle 82c or the inlet region of nozzle 81c.

Ducts 95, 96 can issue tangentially into said associated inner area in such a way that the whirling rotation direction of both pressure flows is directed in the same or opposite directions and in the former case a particularly high acceleration is obtained and in the latter case a particularly pronounced whirling action. The whirling devices 86c, 87c or the guide bodies and the lateral boundaries of ducts 95, 96 are in this case exclusively formed by corresponding shaping of the remote end faces of the nozzle end plate 75c or nozzle cap 71c, so that the facing end faces of inner body 72c and nozzle end plate 74c can be given a planar construction and merely serve to bound the channels and chambers on one side. However, it is also conceivable to only guide the liquid via a whirling chamber and to allow the air to flow out directly from the nozzle via an annular passage, or conversely only to guide the air via a whirling chamber.

FIG. 10 shows a double rotation discharge nozzle 25d, in which the medium in the nebulizing or whirling device 87d in a first stage is brought into a corresponding flow pattern and then in a second whirling or nebulizing device 86d is brought into a whirling flow directed in the same or opposite direction and in particular accompanied by acceleration. For this purpose, the discharge opening 84d of the nozzle channel of nozzle 82d issues outside nozzle axis 69d and/or opposite to the same in sloping manner and in the present embodiment there is a nozzle channel sloping by approximately 45° or more with respect to nozzle axis 69d and whose inlet opening 85d is positioned eccentrically or in spaced manner with respect to nozzle axis 69d. The supply of compressed air can take place in the whirling chamber 86d or in a further, following and separate chamber.

Figure 11:
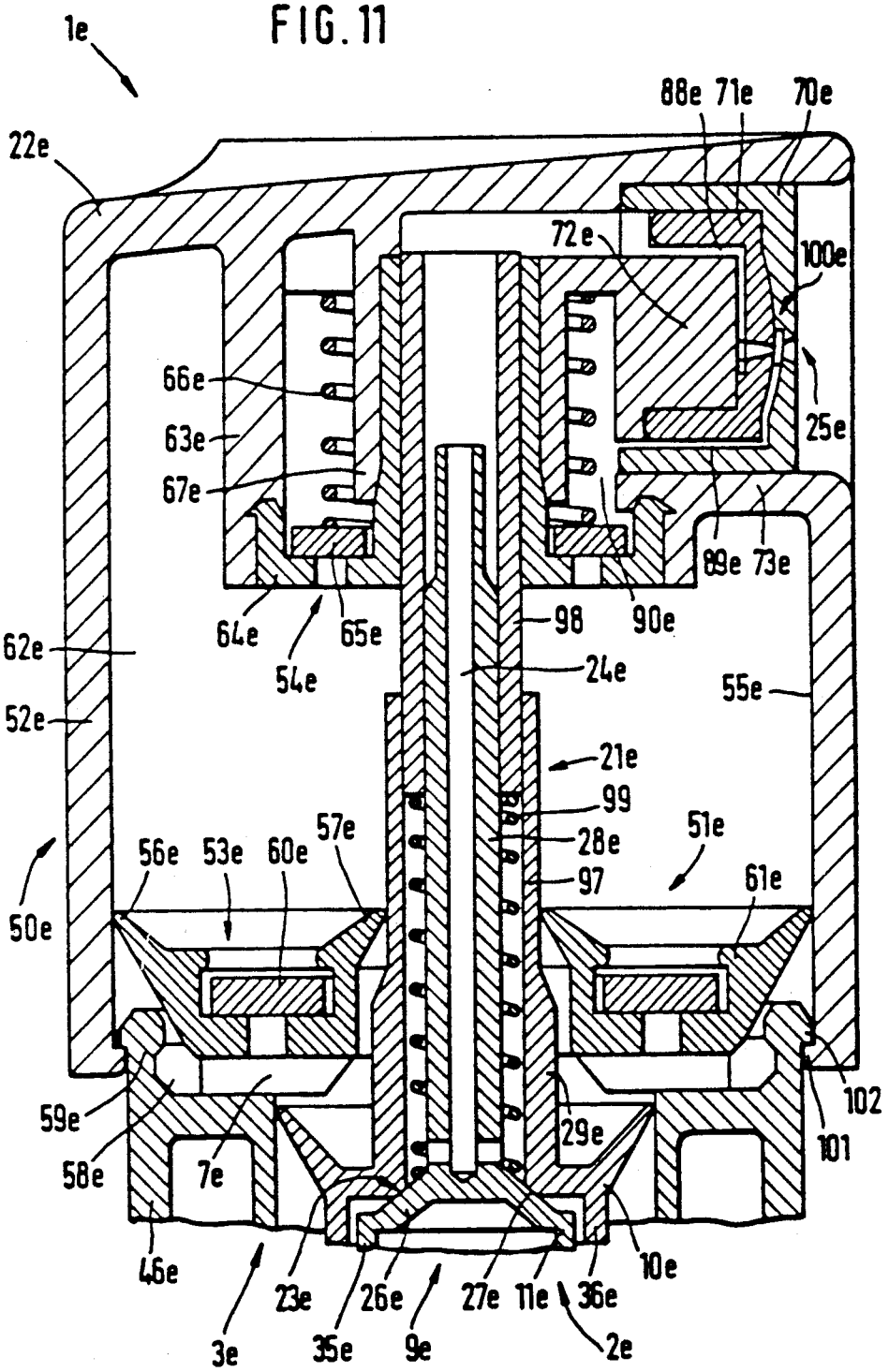
FIG. 11 shows another embodiment of a discharging apparatus in a representation similar to FIG. 2.

FIG. 11 shows a discharging apparatus 1e, in which the handle 22e at the start of its operating path associated with the pump stroke only operates the compressed air pump 50e and then the medium pump 2e and preferably there is an operating rod for both pumps, formed in the present case by piston rod 21e and this has a stop-limited idle movement up to the carrying along or operation of the medium pump 2e. Instead of this or in addition thereto, the arrangement can also be such that the handle 22e at the end of the pump stroke of medium pump 2e and up to the following further operation of the compressed air pump 50e, has a following or residual path or travel, so that pump 50e can be further operated over a residual stroke following the end of the stroke of pump 2e in a continuation of its already performed pump stroke.

In the first case, due to the idle movement prior to the start of the stroke of medium pump 2e or before or after closing its inlet or passover valve and at least in the pressure chamber 62e an overpressure is built up or even, in the case of a corresponding matching of the outlet valve 54e constructed as a spring-loaded plate valve, prior to the opening of the medium outlet valve 23e compressed air is passed into the discharge nozzle 25e. In the second case, following the end of the stroke of medium pump 2e compressed air is further supplied to the discharge nozzle 25e and as a result it can be cleaned or blown free of residual medium particles.

To this end, in the embodiment according to FIG. 11, the piston rod 21e is constructed as a tubular telescopic rod spring-loaded towards the stretched position and whose outer rod part 97 forms a component with pump piston 10e and whose other, inner rod part 98, is connected firmly to the handle 22e via insert 64e. The two rod parts 97, 98 engage in one another in the vicinity of the pressure chamber 62e between the compressed air pump piston 51e and the end face of bush 63e and on the end face of the inner rod part 98 is supported by one end a stretching spring 99 in the form of a helical compression spring, whose other end is supported with respect to the rod part 97 and, as shown, can also be supported on the presuction piston 11e or on the valve closing part 26e of medium outlet valve 23e, so that the stretching spring 99 acts counter to the valve spring thereof and on reaching a predetermined spring tension can then initiate the substantially displacement-dependent opening of outlet valve 23e.

By itself or in conjunction with a further spring only acting following a predetermined relative displacement of rod parts 97, 98, the stretching spring 99 can have a stepped spring characteristic in such a way that the resistance exerted by spring 99 in a first step is so small compared with the tension of the restoring spring of medium pump 2e, that at the start of the operating path of handle 22e only the compressed air pump 50e is operated, whilst medium pump 2e remains unoperated. In a second step, the resistance of the stretching spring 99 suddenly increases to such an extent compared with the restoring spring of medium pump 2e that this is operated substantially synchronously with the compressed air pump 50e. At the end of the travel of medium pump 2e, a residual path can be available for operating the compressed air pump 50e against the increased resistance of the stretching spring 99. The pump stroke end position of the compressed air pump 50e is appropriately limited by the handle 22e striking against piston unit 9e or against the end face of the rod part 97 of piston rod 21e, against which strikes the end face of bush 63e or insert 64e.

Figure 1:
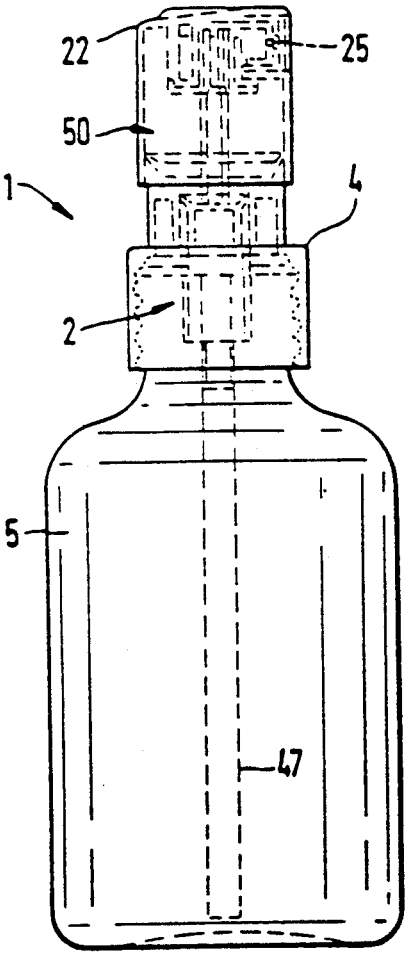
FIG. 1 shows an inventive discharging apparatus in elevation.
Figure 2:
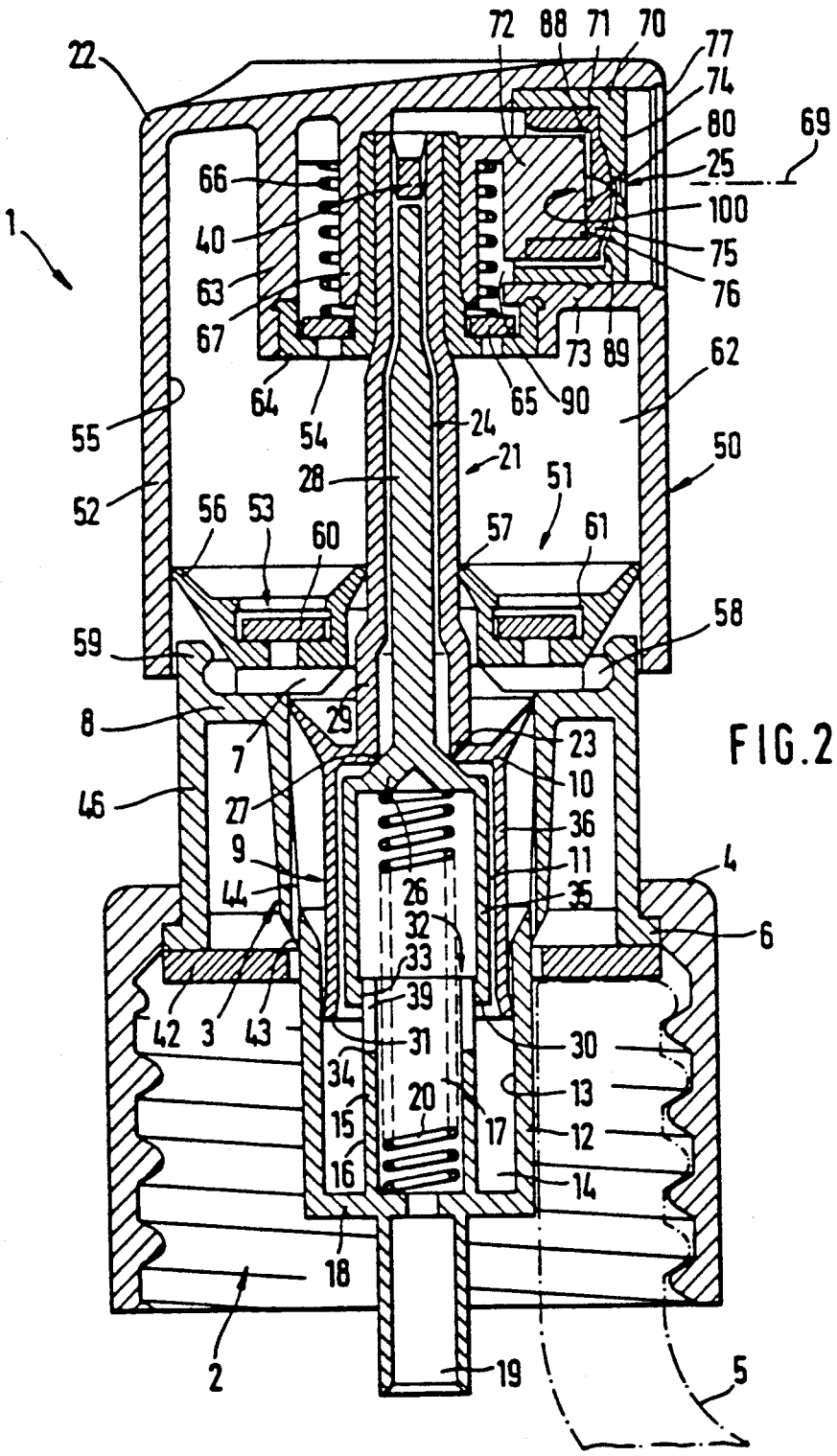
FIG. 2 shows an axial section through part of the discharging apparatus according to FIG. 1 on a larger scale.

Whereas in the embodiment according to FIGS. 1 to 3, the outlet channel 24 is provided on the outer circumference of shaft 28, in the embodiment of FIG. 11 it is provided in the interior of the tubular shaft 28e. In the embodiment according to FIGS. 1 to 3 the pump chamber 14, if it has not yet been filled with medium, can consequently be relatively easily ventilated in that at the end of the stroke of medium pump 2, the pump piston 10 is stop-fixed and then by further pressing of handle 22 via dog 40 outlet valve 23 can be opened mechanically or in displacement-dependent manner. There is no such arrangement in the embodiment according to FIG. 11, but it would be conceivable if the dog reached the end of shaft 28e just prior to the pump stroke end position of compressed air pump 50e. Shaft 28e is displaceably guided in the rod part 98 and is surrounded by the stretching spring 99 located within rod part 97.

As is further shown in FIG. 11, the compressed air pump 50e or the handle 22e is stop-limited in the starting position with respect to a casing part, particularly with respect to the sleeve 46e or stop 59e of cylinder casing 3e of medium pump 2e. For this purpose, the pump piston 52e is provided at its end with an inwardly directed collar as the stop 101 and with it is associated as a counterstop 102 a collar of cylinder casing 3e projecting over the outer circumference and located in the vicinity of the counter member for snap element 58e. Stop 101 and counterstop 102 can be so in sealing engagement with one another in the starting position that the air supply to the compressed air pump 50e and the ventilation for the vessel are hermetically outwardly sealed.

Figure 12:
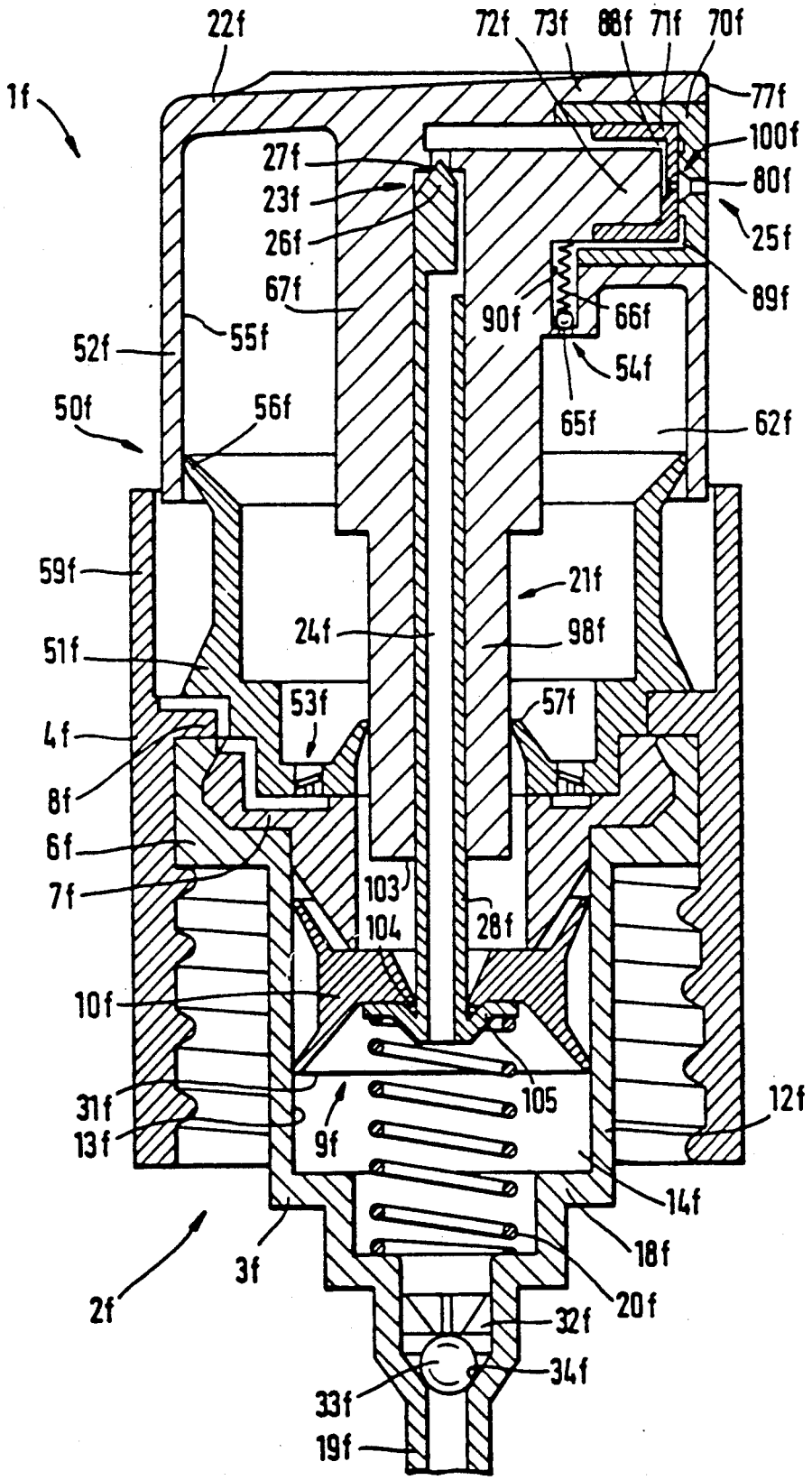
FIG. 12 shows another embodiment of a discharging apparatus in a representation corresponding to FIG. 2.

Whereas in the embodiment according to FIG. 11 the medium outlet valve 23e is positioned horizontally in the vicinity of pump piston 10e or in the associated cylinder housing 3e and the medium outlet channel 24e in the flow direction behind the same is connected in the outlet valve 23e issuing into the annulus between shaft 28e and rod part 97 via transverse bores in shaft 28e, in the embodiment according to FIG. 12 the medium outlet valve 23f is provided outside the cylinder housing 3f in the vicinity of the compressed air pump 50f or within the pin bush 67f of handle 22f and in this case the handle or the compressed air pump cylinder 52f forms a component of piston shaft 21f. As shown, the outlet valve 23f can be constructed in the manner of a needle or pin valve, as a check valve, as a separate, medium pressure-influenced control piston-operated valve and in particular as a hose valve according to German Patent 29 02 624.

Outlet valve 23f is located very close to the discharge nozzle 25f or immediately on the side of inner body 72f remote therefrom, so that between it and the nozzle channel is only provided the angular channel portion 88f, in which only small medium residues can remain and which can be easily cleaned or blown free by corresponding reversal of the compressed air. In the represented embodiment the compressed air outlet valve 54f is a spring-loaded ball valve, whose valve casing formed by the cylinder casing of the compressed air pump or handle 22f is located between the pump axis and discharge nozzle 25f in such a way that it is directly connected to one leg of the compressed air channel portion 89f. In this case the compressed air pump cylinder 52f engages with a small gap in the inner circumference of the collar-like part 59f, which like the partition 8f is constructed in one piece with cap 4f constructed as a screwcap.

In this embodiment the medium pump 2f does not have double piston and instead only has a single pump piston 10f on piston unit 9f and this is essentially formed by an annular piston disk, over whose front and/or rear end projects a frustum-like widened piston lip. The front piston lip in the pump stroke end position engages on the bottom wall 18f formed by an offset ring shoulder and in the direction towards the inlet channel 19f it passes into a multiply offset, outer circumferentially reduced end portion of cylinder casing 3f. In said end portion is provided a check valve as the suction valve 32f in the form of a ball valve with a spherical valve closing part 33f and a conical valve seat 34f.

The cylinder casing 3f is constructed in one piece with the ring flange 6f projecting over the outer circumference at its outer end and which is supported with its free end face on partition 8f and can be so braced with the remote, annular end face against the vessel neck that it forms a seal corresponding to gasket 42.

At the outer end cylinder 12 or cylinder casing 3f is closed by a ring or bush-like cylinder cover 7f traversed by the piston shaft 21f and by means of the collar projecting over its outer circumference is sealed into an inner groove of ring flange 6f in such a way that it is also axially supported on partition 8f. An inner frustum-shaped end of the cylinder cover 7f projecting into the circumferential surface of cylinder casing 3f and on the outer circumference corresponding to the rear piston lip of pump piston 10f in the initial position of said pump piston engages as a stop with a relatively sharp ring edge on pump piston 10f or on the rear end face of its piston disk, so that a seal is also obtained against the compressed air pump 50f.

The piston shaft 21f is displaceable out of the starting position with respect to the pump piston 10f by an idle movement, by means of which the pump 50f is operated, whereas the medium pump 2f remains unoperated through pump piston 10f remaining stationary. At the end of the idle movement, the piston shaft 21f strikes by a dog against the back of the piston disk of pump piston 10f and then moves it with it up to its stroke end position. The dog 103 located outside the compressed air pump 50f in the starting position within the cylinder cover 7f is formed by a ring shoulder of piston shaft 21f, which is in turn formed by the end face of the rod part 98f connected to pump cylinder 52f or handle 22f or constructed in one piece therewith and which can form an external cross-sectionally reduced extension of socket or bush 67*f*.

Particularly in the case of a displaceable mounting of the valve closing part 26*f* of the medium outlet valve 23*f*, piston shaft 21*f* is constructed in the manner of a telescopic rod, whose inner, tubular rod part 28*f* forming the outlet channel 24*f* is formed in the vicinity of the associated end of the valve closing part 26*f*. The piston shaft 22*f* or the rod part 28*f* passes through the pump piston 10*f* in the vicinity of a passage opening in the piston disk, whereby on the inner circumference of pump piston 10*f* there is at least one sealing lip for the sealed guidance on the outer circumference of said rod part 28*f*. On the end located within pump chamber 14*f*, the rod part 28*f* has a rod collar 105 projecting over its outer circumference, or a comparable driving member for the return stroke of pump piston 10*f*, which can strike against the associated end face of the piston disk and can be supported on the restoring spring 40*f*.

The outer and inner piston lips 56*f* and 57*f* of the pump piston 51*f* of the compressed air pump 50*f*, in this embodiment are axially reciprocally displaced by more than the stroke of the medium pump 2*f* or the compressed air pump 50*f*, the inner piston lip 57*f* being located substantially within the ring flange 6*f* or the cylinder casing 3*f*, whilst the outer piston lip 56*f* is outwardly displaced and can extend at least up to the outer end of the collar 59*f* or beyond the same. The pump piston 51*f* is centered in the cylinder cover 7*f* or ring flange 6*f* and also in the partition 8*f* and is inserted in sealed manner except for the air supply and for this purpose between its bottom wall and the piston lip 56*f* has a multiply stepped, profiled circumferential surface part on the outer circumference.

Figure 13:
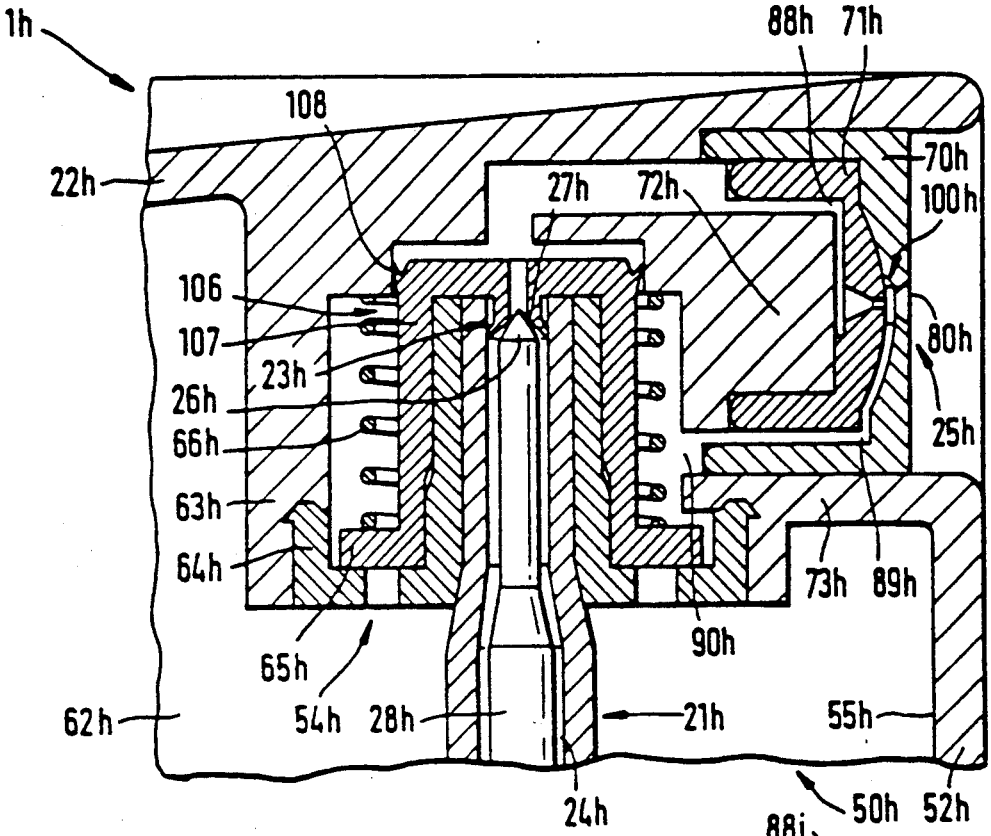
FIG. 13 shows a detail of another embodiment of a discharging apparatus in axial section.

FIG. 13 shows an advantageous construction of a control device 106 for an opening of the medium outlet channel 24*h* or the compressed air channel 90*h* or both channels delayed with respect to the travel of handle 22*h*. There is preferably a control piston 107 influenced by the compressed air pressure in the compressed air chamber 62*h* for operating at least one movable valve body 27*h* or 65*h*. Control piston 107 spring-loaded in the closing direction is constructionally combined with the valve body 65*h* of the compressed air outlet valve 54*h*, with which it forms a cup-shaped collar sleeve, whose collar provided at one end forms the valve body 65*h* and which is closed at the other end by a ring disk-like bottom wall, which with a shoulder projecting counter to the flow direction in piston shaft 21*h* forms the valve seat 27*h*, with which can be associated as the valve closing part 26*h* a part firmly seated in piston shaft 21*h* or movable with shaft 28*h*.

The circumferential surface of control piston 107 is displaceably guided on the outer circumference of the associated end of piston shaft 21*h* or the sleeve part of insert 64*h* surrounding the same about the opening path of the two valves with respect to the common valve spring 66*h*. For the reciprocal sealing of the two passage paths, namely passage portion 88*h* on the one hand and passage portion 89*h* and the compressed air passage 90*h* on the other, the control piston 107 is sealingly guided on a running path of bush 63*h* with a sealing lip 108 located in the vicinity of its bottom wall, said running path being provided following on to the annular clearance for valve spring 66*h*.

The control device 106 for the joint control of both the pressurized gas and also the medium with respect to its release to the discharge nozzle 25*h* on reaching the predetermined pressure in pressure chamber 62*h*, opens both nozzles simultaneously or successively in that through said overpressure initially the valve closing part 65*h* of outlet valve 54*h* is transferred into the open position. Thus, the control piston 107 is entrained by the valve closing part 65*h*, so that the valve seat 27*h* provided thereon rises simultaneously or in delayed manner from the valve closing part 26*h* and consequently also opens. Correspondingly and conversely the medium outlet valve 23*h* can close again simultaneously with or prior to the compressed air outlet valve 54*h*. Thus, the control device 107 has at least one valve leading to the medium nozzle and at least one leading to the compressed air nozzle, preferably that leading to the compressed air nozzle opens before and/or closes after the other valve.

Figure 14:
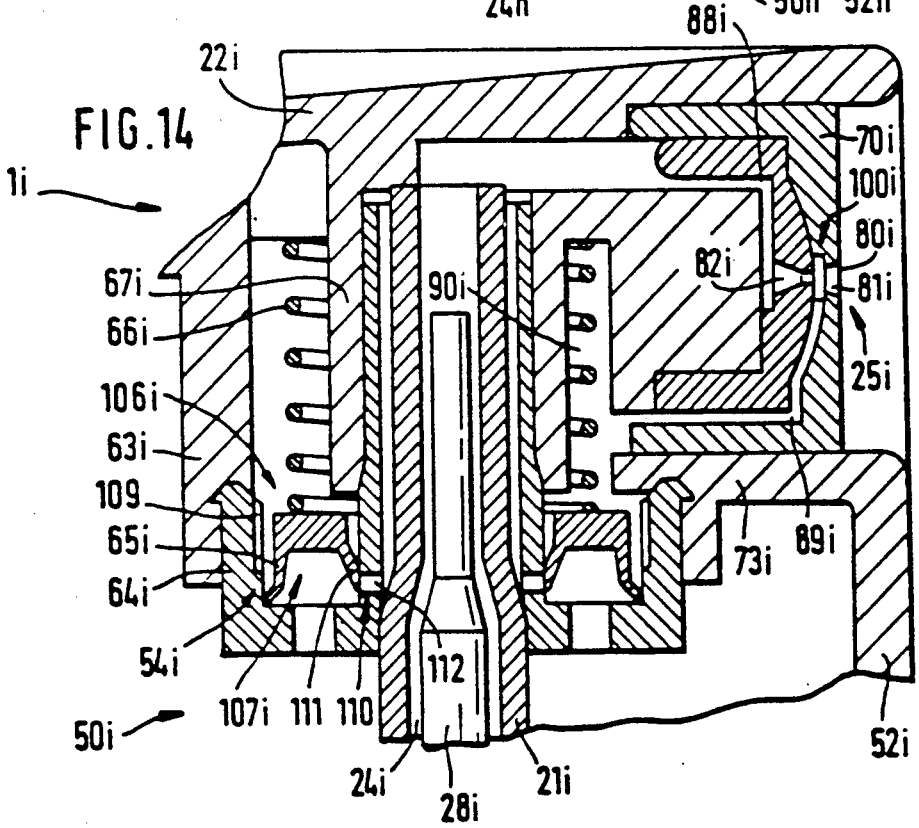
FIG. 14 shows another embodiment in a representation corresponding to FIG. 13.

FIG. 14 shows a control device 106*i* for reversing at least part of the compressed air flow from the pressure chamber in at least a part and in particular the end part following onto the discharge nozzle 25*i* or in the latter and preferably a control piston 107*i* influenced by the compressed air pressure is provided for operating at least one movable valve body. Instead of this or in addition thereto, it is also conceivable to have the control piston influenced by the pressure in the medium outlet channel 24*i*.

In this case the compressed air outlet valve 54*i* is constructed as a slide valve and not as a plate valve and the sleeve-like valve closing part in the manner of a ring sealing lip is provided as a valve slide on the outer circumference of control piston 107*i* and is movable both into and out of the area of the valve slots on an inner circumferential surface of the compressed air channel 90*i* enclosing the ring gap for valve spring 66*i*. The valve slots 109 can be provided in simple manner on the collar-like casing of insert 64*i*. In the case of an overpressure in the compressed air chamber of compressed air pump 50*i* the annular control piston 107*i*, from which the valve closing part 65*i* projects in the direction of the pressure chamber, is so displaced counter to the tension of valve spring 66*i* that the sealing lip of valve closing part 65*i* passes from a valve slot-free area into the area of the valve slots 109, so that the compressed air can pass from the compressed air chamber into the compressed air channel 90*i*.

Control device 106*i* or control piston 107*i* operates a further air closing valve 110, for which a further, corresponding sleeve-like valve closing part 111 projecting in the same direction and similar to valve closing part 65*i* is provided on the inner circumference of control piston 107*i*. With said valve closing part 111 is associated at least one or a ring of uniformly distributed valve openings 112 on an outer circumferential surface, said valve openings 112 being provided in simple manner in the sleeve part of insert 64*i* in the form of radial bores and issue into an annular channel between the associated end of piston shaft 21*i*, as well as its sleeve part and from there into the medium channel portion 88*i*.

In the starting position, the compressed air outlet valve 54*i* and the and the slide closing valve 110 are closed by the associated valve closing parts 65*i*, 111. Under the rising compressed air overpressure, the control piston 107*a* is initially moved over a partial path and consequently the air closing valve 110 is opened, so that the compressed air flows in the liquid path or channel portion 88*i*. As the compressed air strikes against the liquid simultaneously conveyed in the medium channel portion 88*a*, a backwash occurs and optionally through the pressure further rising in the compressed air chamber, the control piston 107*a* is moved further counter to the tension of valve spring 66*a*, so that now the initially closed compressed air outlet valve 54*i* opens and the compressed air can flow to the channel portion 89*i*. If the liquid flow is interrupted, e.g. at the end of the medium pump stroke, then the outlet valve 54*i* closes due to the lack of the backwash or counterpressure, so that the control piston 107*i* now moves back by the corresponding partial path. However, the closing valve 110 remains opens, so that the air which is still under pressure in the compressed air chamber flows into the associated liquid paths or channel portions and cleans the same, including the discharge nozzle 25*i*. It is also conceivable to control this reversal mechanically or in displacement-dependent manner.

Independently of the illustrated combination of two separate pressure sources for two separate media, namely e.g. a liquid to be discharged and a pressurized gas or another fluid, the individual components of the discharging apparatus, e.g. the pumps, their components, the valves, the control means and the discharge nozzles, constitute feature combinations essential to the invention.

We claim:

1. A manually operable dispenser for media, comprising:

A medium pump operable by a handle and including a basic support body and which has a pump chamber, connected to a media outlet channel leading to a discharge nozzle; and at least one manually operable compressed air pump, having at least one compressed air chamber which is connected by at least one compressed air channel at least indirectly to the discharge nozzle , and said air pump having a pump piston separable from said support body and traversed by an operating shaft of said medium pump, said piston being axially supported against air pressure in said air chamber by axial contact against said basic support body.

2. The dispenser according to claim 1, wherein the air pump is constructually combined with the medium pump and is simultaneously operable with said handle.

3. The dispenser according to claim 1, wherein the air pump is substantially equiaxially positioned with respect to the medium pump and compared with said medium pump has a larger delivery volume per pump stroke, said air pump providing an inlet traversing said pump piston.

4. The dispenser according to claim 1, wherein the air pump provides an extension of the medium pump.

5. The dispenser according to claim 1, wherein at least one of said air pump and said medium pump is constructed as a thrust piston pump and is operable by finger pressure by means of the handle, said handle being constructed as an operating head and carrying the discharge nozzle.

6. The dispenser according to claim 1, wherein said air pump is located directly adjacent to the medium pump and is constructed partly in one part with said medium pump, said operating shaft providing a piston shaft of the medium pump.

7. The dispenser according to claim 1, wherein said air pump is substantially located within said handle, said handle providing a pump cylinder of said air pump.

8. The dispenser according to claim 1. wherein said pump piston of the air pump is supportingly connected to said support body by a snap connection provided on an associated end of a cylinder casing of the medium pump.

9. The dispenser according to claim 1, wherein the air pump closes a pump casing of said medium pump at an outer end, said pump piston forming a cylinder closure for the medium pump, said pump piston separating said air chamber and said pump chamber by sealing lips.

10. The dispenser according to claim 1, wherein said air pump has an outlet valve providing a valve seat member separate from said handle and located at an end of said air chamber remote from said medium pump.

11. The dispenser according to claim 1, wherein an inlet valve is encapsulated within the air pump and within an outer circumference of said pump piston providing a valve seat for an operationally movable valve body.

12. The dispenser according to claim 1, wherein a common restoring spring is provided for both said pumps, said restoring spring forming a valve spring of an outlet valve for said outlet channel of said medium pump, said outlet channel being located inside said operating shaft.

13. The dispenser according to claim 1, wherein the medium outlet channel and the compressed air channel issue separately into said discharge nozzle having a nozzle duct, said compressed air channel issuing into the nozzle duct downstream of said medium outlet channel.

14. A manually operable dispenser for media, comprising:

a medium pump operable by a handle and having a pump chamber connected to a medium outlet channel leading to a discharge nozzle; and at least one manually operable compressed air pump having at least one compressed air chamber connected by at least one compressed air channel at least indirectly to said discharge nozzle, wherein said pump chamber of said medium pump, on an initial portion of an operating stroke of said air pump, is opened for pressure relief purposes via an inlet valve constructed as a slide valve and is closed on a following stroke portion until a medium outlet valve opens.

15. A manually operable dispenser for media, comprising:

a medium pump operable by a handle and having a pump chamber connected to a medium outlet channel leading to a discharge nozzle; and at least one manually operable compressed air pump having at least one compressed air chamber connected by at least one compressed air channel at least indirectly to said discharge nozzle, wherein an outlet valve of said air pump opens before a medium outlet valve of said medium pump and closes after said medium outlet valve.

16. A manually operable dispenser for media, comprising:

a medium pump operable by a handle and having a pump chamber connected to a medium outlet channel leading to a discharge nozzle; and at least one manually operable compressed air pump, having at least one compressed air chamber connected by at least one compressed air channel at least indirectly to said discharge nozzle, wherein control means is provided for delayed opening of at least one of channels defined by said medium outlet channel and said compressed air channel with respect to operating said handle, said control means including a control piston influenced by compressed air pressure for operating at least one movable valve body.

17. A manually operable dispenser for media, comprising:

a medium pump operable by a handle and having a pump chamber connected to a medium outlet leading to a discharge nozzle; and at least one manually operable compressed air pump having at least one compressed air chamber connected by at least one compressed air channel at least indirectly to said discharge nozzle, wherein control means is provided for reversing at least part of a compressed air flow in at least one of ducts defined by said medium outlet channel and said discharge nozzle, said control means including a control piston influenced by at leat one of pressures defined by a compressed air pressure and pressure in said medium outlet channel for operating at least one movable valve body.

18. The dispenser according to claim 16 or 17, wherein said control means operates at least two separate compressed air valves leading to separate portions of a nozzle channel of said discharge nozzle through channel portions provided for ductively connecting said air pump and said medium pump respectively to said separate nozzle channel portions.

19. A manually operable dispenser for media comprising:

a medium discharger operable by a handle and having a pressure chamber connected to a medium outlet channel leading to a discharge nozzle; and at least one manually operable compressed air discharger, movable through an operating stroke and having at least one compressed air chamber connected by at least one compressed air channel at least indirectly to said discharge nozzle, wherein said pressure chamber of said medium discharger on an initial portion of said operating stroke of said air discharger is opened for pressure relief purposes.

20. A manually operable dispenser, for media, comprising:

a medium discharger operable by a handle and having a pressure chamber connected to a medium outlet channel leading to a discharge nozzle; and at least one manually operable compressed air discharger, having at least one compressed air chamber connected by at least one compressed air channel at least indirectly to said discharge nozzle, wherein an outlet valve of said air discharger opens before an medium outlet valve of said medium discharger and closes after said medium outlet valve.

21. A manually operable dispenser for media, comprising:

a medium discharger operable by a handle and having a pressure chamber connected to a medium outlet channel leading to a discharge nozzle; and at least one manually operable compressed air discharger, having at least one compressed air chamber connected by at least one compressed air channel at least indirectly to said discharge nozzle, wherein control means is provided for delayed opening of at least one of channels defined by said medium outlet channel and said compressed air channel with respect to operating said handle, said control means including a control piston influenced by compressed air pressure for operating at least one movable valve body.

22. A manually operable dispenser for media, comprising:

a medium discharger operable by a handle and having a pressure chamber connected to a medium outlet leading to a discharge nozzle; and at least one manually operable compressed air discharger, having at least one compressed air chamber connected by at least one compressed air channel at least indirectly to said discharge nozzle, wherein control means is provided for reversing at least part of a compressed air flow in at least one of ducts defined by said medium outlet channel and said discharge nozzle, said control means including a control piston influenced by at least one of pressures defined by a compressed air pressure and pressure in said medium outlet channel for operating at least one movable valve body.

23. The dispenser according to claim 21 or 22, wherein said control means operates at least two separate compressed air valves leading to separate portions of a nozzle channel of said discharge nozzle through channel portions provided for ductively connecting said air discharger and said medium discharger respectively to said separate nozzle channel portions.

* * * * *